United States Patent [19]

Rose et al.

[11] 4,362,115

[45] Dec. 7, 1982

[54] METHOD OF AND APPARATUS FOR TOP STITCHING

[75] Inventors: John A. Rose, Knaresborough; Keith Dyer, Leeds, both of England

[73] Assignee: AMF Incorporated, White Plains, N.Y.

[21] Appl. No.: 187,396

[22] Filed: Sep. 15, 1980

[30] Foreign Application Priority Data

Sep. 14, 1979 [GB] United Kingdom ..... 7931892

[51] Int. Cl.[3] ..... D05B 97/00; D05B 21/00

[52] U.S. Cl. ..... 112/262.3; 112/121.12; 112/DIG. 3

[58] Field of Search ..... 112/121.11, 308, 309, 112/275, 274, 272, DIG. 2, DIG. 3, 153, 262.3, 262.1, 121.12, 121.15

[56] References Cited

U.S. PATENT DOCUMENTS

| | | | |
|---|---|---|---|
| 2,759,444 | 8/1956 | Schwab et al. | 112/275 X |
| 3,096,237 | 7/1963 | Bono | 112/308 |
| 3,332,378 | 7/1967 | Adam et al. | 112/308 X |
| 3,631,826 | 1/1972 | Morgan | 112/DIG. 2 |
| 3,693,561 | 9/1972 | Hrinko, Jr. et al. | 112/308 X |
| 4,019,447 | 4/1977 | Blessing et al. | 112/308 X |
| 4,181,085 | 1/1980 | Conver, Jr. | 112/121.12 |
| 4,226,197 | 10/1980 | Pottmier et al. | 112/308 X |

FOREIGN PATENT DOCUMENTS

| | | | |
|---|---|---|---|
| 935947 | 12/1955 | Fed. Rep. of Germany | 112/272 |

*Primary Examiner*—H. Hampton Hunter

*Attorney, Agent, or Firm*—David E. Dougherty; Charles J. Worth

[57] ABSTRACT

In a method of and apparatus for top stitching parallel to the edge of a garment panel in which edge is a corner, there are provided means for detecting the approach of the corner and thereupon reducing the speed of movement of the panel through the machine and means acting on the underside of the panel to impart a turning motion thereto.

5 Claims, 4 Drawing Figures

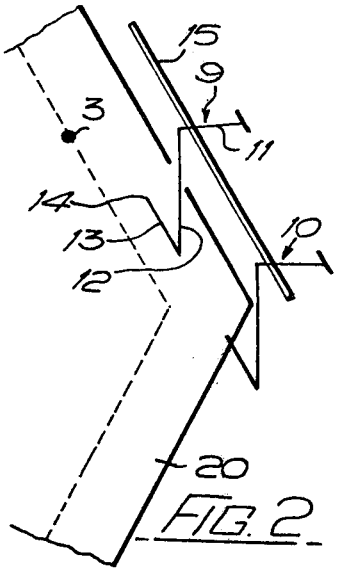
FIG. 2
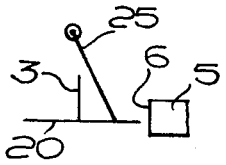
FIG. 3
FIG. 4
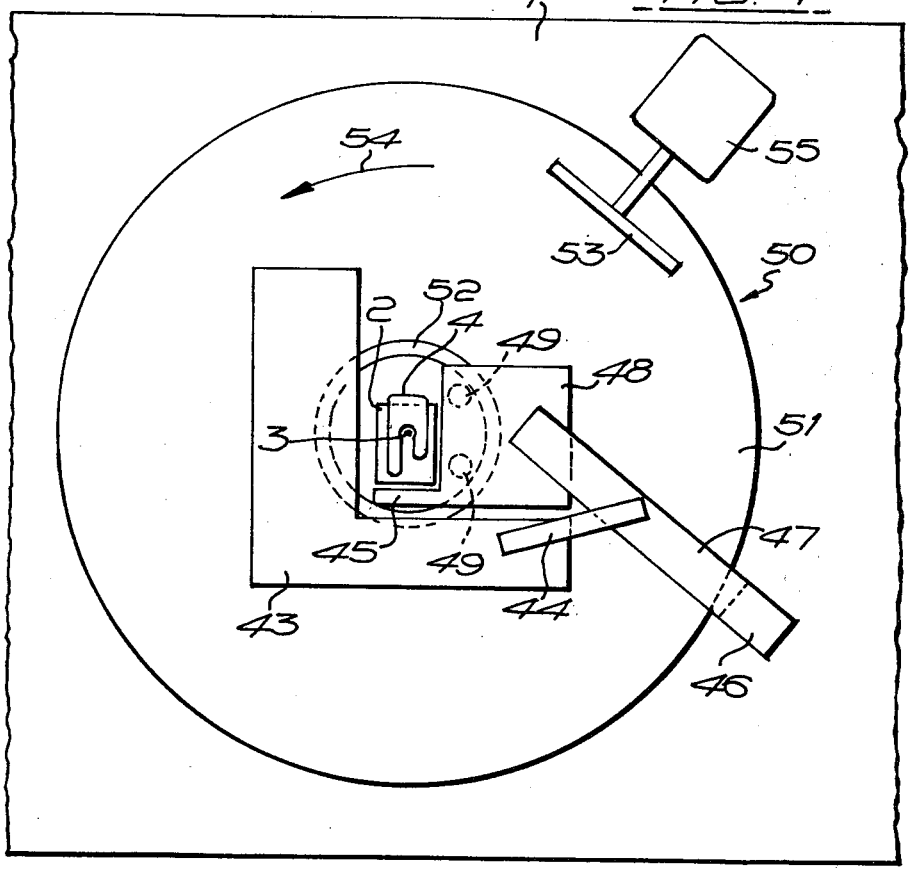

METHOD OF AND APPARATUS FOR TOP STITCHING

The invention relates to a method of and apparatus for the production, in a sheet material, of a line of machine stitching having a change of direction, particularly but not exclusively for use in top stitching of a garment part.

Whilst the machine stitching of fabric panels for example for garment parts along pre-determined lines can often be effected by means of a jig, the method is not completely satisfactory for the so-called topstitching process whereby, two fabric panels having been sewn together adjacent their edges and the composite assembly having been turned inside out, it is required to stitch the assembly along a line at an accurately pre-determined distance from the edge of the assembly. Whereas the first mentioned sewing operation can readily been effected by means of a jig, the dimensional variations produced by the successive steps of first stitching and then turning inside out are such that use of a jig for the top stitching operation may result in stitch lines which are not sufficiently accurately spaced from the edge of the assembly. It has been found necessary therefore heretofore to carry out top stitching operations by manual control and this has involved that use of very skilled operatives, and it is an object of the invention to enable the operation to be carried out with a minimum of skill.

According to one aspect of the invention there is provided a method for the production in a sheet material of a line of machine stitching having a change of direction therein comprising the steps of moving the material through a sewing machine to produce a first portion of stitch line therein, reducing the rate of movement of the material through the machine, turning the material substantially in its own plane by means acting on the underside thereof and moving the material through the machine to produce a second portion of stitch line.

The turning means may comprise an air stream or a body arranged for rotation about a vertical axis. Preferably each stitch line portion is rectilinear and parallel to an edge of the material. The turning of the material may be effected with the rate of movement reduced to zero and with the needle in the material.

According to a further aspect of the invention there is provided apparatus for the production in a sheet material of a line of machine stitching having a change of direction therein comprising a sewing machine, means for moving the material through the machine to produce a first portion of stitching line therein, means for reducing the rate of movement of material through the machine and means for effecting an action on the underside of the material capable of turning the material in its own plane, and means for moving the material through the machine to produce a second portion of stitching line therein.

The means for effecting a turning action may comprise a plurality of air jets or a body rotatable about a vertical axis. Means may be provided for ensuring that with the rate of movement reduced to zero the needle is in the material when the material is turned.

Preferably the machine also comprises guide means whereby each portion of the stitch line can be produced in parallel with an edge of the material, and the apparatus may also comprise sensing means for determining upstream of the needle in respect of the movement of the material when the edge of the material changes direction.

Embodiments of the invention will now be described by way of example and with reference to the accompanying drawings, of which:

FIG. 2 is a detailed perspective view of a portion of the apparatus of FIG. 1;

FIG. 3 is a detailed in-front elevation of a portion of a further embodiment; and FIG. 4 is a perspective view of an alternative embodiment.

Figure 1:
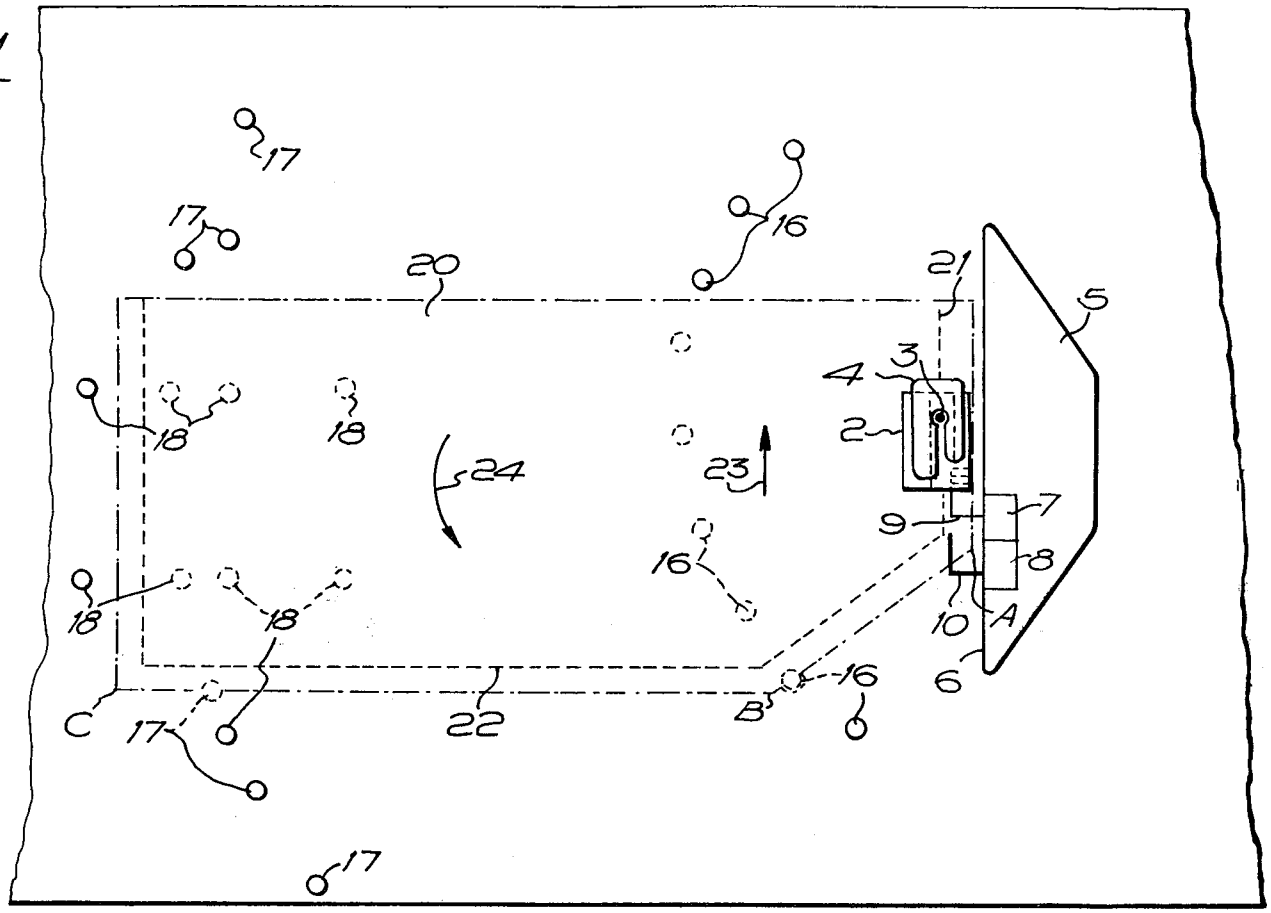
FIG. 1 shows a plan view of one embodiment of apparatus employed in profile stitching a garment panel.

The apparatus shown in FIGS. 1 and 2 comprises a sewing machine of generally conventional construction and comprising a base 1 into the upper surface of which is inset feed dog 2 and above which is supported an arm (not shown) from which depends a vertically reciprocating needle 3 and a vertically movable foot 4.

Inasmuch as the above identified features are concerned the machine is conventional, but in addition to the conventional features the sewing machine of the invention further comprises a guide block 5 mounted on the base 1 and having a guide edge 6 parallel to the direction which is imparted to a sheet material such as a garment panel comprising an assembly of textile fabric panels located above the feed dog 2 and under the foot 4 during the stitching operation of the machine. The block 5 is so located in relation to the needle 3 that with a garment panel moving through the machine with an edge in contact with edge 6, the line of stitching produced by the needle 3 is located at the desired distance from the edge of the panel.

The guide block 5 itself mounts micro switches 7 and 8 which are operated respectively by feelers 9 and 10 the shape of which is more particularly shown in FIG. 2. As can be seen from FIG. 2 each of the feelers 9, 10 comprises a stiff wire pivotally mounted about a horizontal axis parallel to edge 6 and comprising a horizontal portion 11 perpendicular to the axis, a vertical portion 12 and a horizontal portion 13 parallel to the axis and terminating at end 14. A rod 15 operatively connected to the foot 4 is located beneath the portions 11 of the feelers 9, 10 with the foot 4 in its lowermost, stitching, position but when raised by the lifting of the foot 4 tilts the feelers about their pivots so as to raise the portions 13.

An arcuate row of nozzles 6 is located in the base 1 and each is connected to source of high pressure air and arranged to blow a stream of air at an angle of about 45° above the base 1 and substantially tangential to the said arc. Nozzles 17 also located in the base 1 are arranged in a further arc about the needle 3 at a greater distance therefrom and these again are operatively connected to a source of high pressure air and are arranged to produce an air stream at about 45° above the upper surface of the base 1 and substantially tangential to the further arc. Nozzles 18, similarly located in the base 1 and connected to a source of high pressure air are each arranged to produce a jet of air vertically upwardly.

For the purpose of illustrating the operation of the machine, FIG. 1 further shows in chain dotted line a garment panel 20 which may represent two face to face layers of fabric previously stitched together at their edges and turned inside out. The panel may, for example, comprise a pocket flap for a garment and is shown by way of illustration as comprising two 45° corners A and B and a 90° corner C. In the position shown in FIG.

1, the panel 20 is located with one edge abutting surface 6 of guide block 5 and lies above feed dog 2 and under foot 4 in the manner which is conventional for machine stitching. The machine has already inserted stitches along line 21 and the desired line to be followed is shown by dotted line 22.

Unlike the first mentioned stitching which is concealed on the turning of the panel inside out, the line of stitching 21 is intended to be visible and for this reason it is required that it shall lie equidistant from the edge of the panel to a considerable degree of accuracy. It will be obvious that to effect this so-called profile stitching, the panel 20 will have to be turned about an angle as the needle approaches each of corners A, B and C in turn and the apparatus described is capable of effecting this turning automatically.

Again as shown in FIG. 1 and in more detail in FIG. 2 the feelers 9, 10 lie with their lower portions 13 resting upon the upper surface of the panel 20.

Considering now the stitching operation commencing with the situation shown in FIG. 1, the feed dog 2 co-operating with foot 4 with the panel 20 sandwiched therebetween operates in the conventional manner to move the panel in the direction shown by arrow 23 whereby the line of stitching 21 is extended. If the panel is extensive and particularly if it is made of heavy or rough fabric, frictional contact of the panel with the base 1 of the machine may significantly inhibit the free backward movement of the panel and in these circumstances the nozzles 18, or some of them, are brought into operation so as to lift the panel to a greater or lesser extent off the base 1 so as to reduce the aforementioned friction.

As the panel moves in the direction of the arrow 23 the free edge 14 of feeler 10 approaches relatively speaking the edge of the panel, and when the edge is reached, the feeler drops off the panel, tilting about its pivot, and makes a connection in the microswitch 8. The switch is connected to the drive of the sewing machine so that the rate of backward movement of the panel is reduced and preferably the rate of reciprocation of the needle is correspondingly reduced so that stitches of the same length are inserted but at a slower speed than initially.

The slowing of the machine facilitates the following arrangement whereby, when eventually the feeler 9 reaches the edge of the panel it, too, drops off the panel and makes the microswitch 7 which is so connected to the sewing machine drive as to effect a complete stopping of the feeding movement of the dog 2, the panel being brought to a standstill at a position accurately located at a distance from the approaching corner A as required by the desired position of the stitch line. If at that moment the needle of the machine is in an upward position completely out of the fabric comprising the panel 20, it is arranged to be lowered to penetrate the fabric without any further forward movement thereof, and the foot is automatically raised so that it does not press the panel against the dog 2. The raising of the foot causes the lifting of the rod 15 which lifts the feelers 9 and 10, but the consequent breaking of the microswitches 7 and 8 is arranged not directly to restart the stitching process.

At this stage, the nozzles 16 17 and 18, or some of them, are brought into operation, the air currents acting on the underside of the panel 20 reducing the frictional contact of the panel on the base 1 and causing the panel to rotate in the sense of arrow 24 about the needle 3 which acts as a pivot for the movement. The air currents are maintained either for a pre-determined period long enough to ensure that the panel 20 has turned at least 45° or until the edge of the panel 20 has again come into abutment with surface 6 of guide block 5 as indicated by a sensor (not shown) of conventional type.

In an alternative embodiment not shown, only the feeler 9 is raised by the rod 15, whilst the feeler 10 is provided at its lower edge with a curved slide by which it is adapted to be raised onto the panel as the panel swings into abutment with the guide block 5, and this lifting of the feeler 10 is employed as a signal comparable with the indication given by the sensor referred to above.

The foot 4 is then lowered into its operative position, the feelers 9 and 10 are lowered simultaneously therewith to rest again on the upper surface of the panel 20, and the machine is set in motion to extend the line of stitching 21 from the corner A towards the corner B. As corner B is approached the operations described are repeated, the panel 20 being turned through a further angle of 45° about the needle 3 in the vicinity of the corner B by means of air currents while the foot 4 is raised and the feed dogs 2 are stationary.

As corner C is reached, the same sequence of operations ensues with the difference that the panel 20 is turned through an angle of 90° before the stitching process is recommenced. It can be shown that by appropriate positioning of the feelers 9 and 10, the apparatus described can, without adjustment, effect a change of direction of the stitch line by two different angles whilst maintaining the stitch line at a pre-determined distance from the edge of the panel.

Modifications may be made to the apparatus without departing from the scope of the invention, and as an example of such modifications reference will be made to FIG. 3 which illustrates a feeler 25 which replaces one of the feelers 9, 10 of the embodiment of FIG. 1 but which similarly operates the corresponding microswitch when it drops on reaching the edge of the panel 20. In this embodiment, the feeler 25 is an elongate strip of stiff or springy material and when resting upon the panel 20 lies in a plane angled downwardly and towards edge 6 of guide block 5. In this embodiment, when the feeler 25 has fallen off the edge of the panel 20 and set in motion the operations described in relation to the FIG. 1 embodiment, the subsequent rotation of panel 20 automatically raises the feeler 25 so that it comes to rest on the upper surface of the panel without the need for an operation corresponding to the raising of rod 15 in the FIG. 1 embodiment. Moreover, once the feeler 25 has regained the position shown in FIG. 3, any tendency in the panel 20 to rebound after having swung about the needle 3 and engaged the edge 6 of guide block 5 is restrained by a pawl-like action of the feeler 25.

A number of alternative possibilities are available for slowing and stopping the movement of the material through the machine on the approach of a corner, and these comprise (a) bringing the stitch length lever, which is a conventional device in a sewing machine, to zero, (b) raising the foot 4 so that the panel is not pressed into contact with the feed dog, (c) raising the throat plate which in a conventional sewing machine surrounds the feed dog in the base of the machine, to a level higher than that of the feed dogs so that the panel 20 is lifted thereby out of driving contact with the feed dog, and (d) lowering the feed dog.

In the embodiment of the invention previously described, the profile to be sewn consists of more or less straight lines joined by a sharp corner. It is also required to sew profiles consisting of more of less straight lines joined by a radiused corner. In an embodiment adapted to satisfy this requirement a single sensor may be used at the corner operatively connected to the drive of the machine to reduce the rate of, but not stop, the movement of the material through the machine and the vertical reciprocation of the needle. The air jets are applied as previously described to turn the material as stitching proceeds at a slow rate for an appropriate period. It may be desirable to reduce the force on and the dimensions of the presser foot. It has been found that, assuming a fed dog of large area is used, a presser foot of similar area will tend to ensure straight line sewing while a foot of smaller area will allow the deviation required for a radiused corner. In view of this, it may be beneficial to make the foot in two parts, both parts to be used along the straight but only one part to be used at a radiused corner.

In the embodiment shown in FIG. 4, a turntable 50 comprising a broad annular plate 51 is mounted on the upper surface of the base 1 of a sewing machine for rotation about a ring 52 within which is located a feed dog 2, above which is a presser foot 4 and along the axis of which lies needle 3.

The turntable 50 is rotated in the direction of arrow 54 by frictional contact with the lower edge of a driving disc 53 which is rotated upon a substantially horizontal axis by motor 55.

The annular plate 51 is only about 4 mm thick, and if the garment panel to be sewn on the machine is longer than the radius of the plate 51, the panel whilst for a large part rests upon the upper surface of the turntable, its extremity drapes over the edge of the annular plate without difficulty and rests on the base 1.

In this embodiment, which is otherwise similar to the embodiment described with reference to FIG. 1, the guide edge 6 is replaced by a pair of discs 49 mounted on the underside of a transparent plastic plate 48 which is mounted clear to the upper surface of the annular plate 51 by means of an arm 47 supported at its other end on a block 46 which is situated at base 1. Extending slightly upwardly from the plate 48 is a plan 45 which serves to hold down a garment panel being sewn by the needle 3. The arm 47 also supports a further arm 44 which in turn carries a guard plate 43 of transparent plastics material.

The turntable 50 replaces the nozzles 16, 17 and 18 of, but the apparatus is otherwise similar to, the embodiment shown in FIGS. 1 and 2. Thus, as already described, the apparatus provides means whereby on the approach of a corner of a garment panel being stitched, the forward movement of the panel through the apparatus is slowed or stopped. At this stage, in one method of working with this embodiment, the turntable is set in rotary motion in the direction of arrow 54 and acts upon the under side of the garment panel to impart a turning motion thereto.

In an alternative method of working with the apparatus of the embodiment the turntable is continuously rotating in contact with the underside of the garment panel and thus urging the panel to turn, but the urging is resisted by the abutment of the panel with the edges of discs 49 which, being spaced apart, have been found more readily to allow the turning of a sharp corner.

The apparatus offers the advantage, particularly important with large garment panels, of reducing the frictional contact of the panel with the stationary base. If the turntable is continuously turning in contact with the underside of the panel, this may assist in keeping the edge of the panel in contact with the discs 49 along the lines of stitching prior to and after the corner.

The friction drive is provided for the turntable so that it may be readily stopped if, for example, it is inadvertantly touched by an operative, in order that no danger shall ensue. Of course, other means of ensuring such safety may be employed, such as introducing a friction clutch into the drive to the turntable.

In a modification of the embodiment, the turntable is recessed into the base 1 and arranged to be elevated into contact with a garment panel when the panel is required to be turned.

We claim:

1. A method for the production in a sheet material of a line of machine stitching having a change of direction, comprising the steps of continuously sensing the position of the material and controlling the production of the line of stitching thereby, moving the material through a sewing machine at a predetermined rate to produce a first portion of the stitch line, reducing the rate of movement of the material through the machine when the sensed material approaches the position for the change of direction of the stitch line, acting on the underside of the material thereby turning the material substantially in its own plane and simultaneously reducing the friction of the turning material until it is sensed to have reached the change of direction of the stitch line, and increasing the rate of movement of the material through the machine to the original rate of movement to produce a second portion of the stitch line along the changed direction.

2. A method according to claim 1, and providing an air stream from the base of the machine acting on the underside of the material.

3. A method according to claim 1, and providing a body arranged for rotation about a vertical axis acting on the underside of the material, and means engaging and preventing the material from turning until reaching the position for a change of direction of the stitch line.

4. A method according to any one of claims 1 to 3 wherein each stitch line portion is rectilinear and parallel to an edge of the material.

5. A method according to any one of the preceding claims 1 to 3 wherein the turning of the material is effected with the rate of movement reduced to zero and with the needle in the material.

* * * * *